US007861666B2

(12) United States Patent
Luebbecke et al.

(10) Patent No.: US 7,861,666 B2
(45) Date of Patent: Jan. 4, 2011

(54) WIDTH ADJUSTABLE MULTI SLOT GUN

(75) Inventors: Kai Luebbecke, Wittorf (DE); Thomas Burmester, Bleckede (DE); Hubert Kufner, Luneburg (DE)

(73) Assignee: Nordson Corporation, Westlake, OH (US)

( * ) Notice: Subject to any disclaimer, the term of this patent is extended or adjusted under 35 U.S.C. 154(b) by 642 days.

(21) Appl. No.: 11/859,254

(22) Filed: Sep. 21, 2007

(65) Prior Publication Data

US 2008/0134966 A1 Jun. 12, 2008

(30) Foreign Application Priority Data

Sep. 22, 2006 (DE) ..... 20 2006 014 743 U

(51) Int. Cl.

| | |
|---|---|
| ***B05B 7/06*** | (2006.01) |
| ***B05B 13/02*** | (2006.01) |
| ***B05B 1/14*** | (2006.01) |
| ***B05C 5/00*** | (2006.01) |

(52) U.S. Cl. ..... 118/314; 118/325; 118/313; 118/315; 118/300; 239/550; 239/601

(58) Field of Classification Search ..... 118/313–315, 118/300, 325, 410, 411; 239/563, 601; 427/207.1; 156/578

See application file for complete search history.

(56) References Cited

U.S. PATENT DOCUMENTS

| | | | | |
|---|---|---|---|---|
| 5,305,955 | A | 4/1994 | Smitherman et al. | |
| 6,540,831 | B1 * | 4/2003 | Craine et al. | 118/314 |
| 7,332,035 | B1 * | 2/2008 | Tudor et al. | 118/315 |
| 2006/0131344 | A1 | 6/2006 | Brass | |
| 2006/0213434 | A1 * | 9/2006 | Ganzer et al. | 118/300 |

FOREIGN PATENT DOCUMENTS

| | | | |
|---|---|---|---|
| DE | 4130432 | C2 | 3/1993 |
| DE | 10103375 | C1 | 6/2002 |
| DE | 10253410 | A1 | 1/2004 |
| DE | 20308257 | U1 | 9/2004 |
| EP | 1260277 | A2 | 11/2002 |
| GB | 1503511 | A | 3/1978 |
| WO | 00/67914 | A2 | 11/2000 |
| WO | 2004/103577 | A1 | 12/2004 |

OTHER PUBLICATIONS

European Patent Office, European Search Report in EP Application No. 07117015, Aug. 18, 2008.

* cited by examiner

*Primary Examiner*—Yewebdar T Tadesse
(74) *Attorney, Agent, or Firm*—Wood, Herron & Evans, L.L.P.

(57) ABSTRACT

Apparatus for applying fluids such as adhesive, in particular hot-melt glue, onto a substrate that is movable relative to the apparatus. The apparatus includes a basic body (12) and an applicator valve (22) for selective interruption or release of the stream of fluid. The basic body (12) is connectable to a fluid source and includes a slit-shaped nozzle opening (54) that communicates with a distribution channel (14), and a piston (16) that is movably situated in the distribution channel (14), by means of which the length of the distribution channel (14) which may be supplied with fluid is variable. The nozzle opening (54) communicates with the distribution channel (14) by means of a plurality of output channels (18) spaced at a distance from each other.

19 Claims, 4 Drawing Sheets

WIDTH ADJUSTABLE MULTI SLOT GUN

TECHNICAL FIELD

The present invention relates to an apparatus for applying fluids such as adhesive, in particular hot-melt glue, onto a substrate that is movable relative to the apparatus.

BACKGROUND

Apparatuses of this sort are frequently also referred to as application heads, and are employed for example when foil or film-type substrates such as labels are to be coated extensively with liquid adhesive, for example hot-melt glue. Normally the flowable adhesive is kept in reserve in a fluid source such as a melting unit. This fluid source is connected to a basic body of the apparatus through a hose connection. Flowable adhesive is carried by a means of conveyance through corresponding holes into the apparatus and on through a distribution channel, and passes through a valve body of an applicator valve. The distribution channel communicates with a slit-shaped nozzle opening, from which the adhesive is dispensed and applied onto a substrate. Since the substrate is movable relative to the apparatus, adhesive is applied extensively to the substrate. Normally the nozzle opening is designed as an elongated slit. The length of the effective section of the slit can be adjusted by a piston that is movably situated in the distribution channel. Such an apparatus is known, for example, from DE 299 08 150.

When coating labels which are to be applied, for example, to bottles, the nozzle opening is normally in a vertical orientation; that is, the slit-shaped discharge opening runs essentially vertically. This can result in the occurrence of an unwanted downward flow component of the fluid in the longitudinal direction of the slit-shaped discharge opening, due to gravity. When the apparatus is stopped for an extended time, a subsequent dripping continues to be disadvantageously perceptible, due to the fact that surplus adhesive runs down the nozzle opening and in time hardens unchecked. In consequence, before each new start-up of the apparatus the adhesive that has run down must be laboriously removed in order to guarantee a uniform application pattern in the coming application.

In those uses in which the application pattern has a plurality of spaced apart strips, application apparatuses are regularly employed with a nozzle arrangement which uses nozzle plates that have a plurality of spaced cutouts, so that within the nozzle arrangement spaced, slit-shaped discharge openings occur through which the adhesive is dispensed in strips and applied to the substrate. To change the application width or pattern, the nozzle plate is uninstalled and a new nozzle plate with a different geometry is inserted into the nozzle arrangement. This process is relatively expensive and complicated. The same is true in the event that the application width must be changed.

The object of the present invention is to improve and to specify an apparatus in which influences of gravity on the flow in the slit-shaped nozzle opening are reduced. Furthermore, according to another aspect the object of the invention is to provide an apparatus that avoids disadvantageous influencing of the application pattern, in particular when the discharge opening is situated vertically, to minimize running down of the adhesive when the apparatus is stopped. According to another sub-aspect, the object is to specify an apparatus in which the shape of the discharge opening, in particular the width of the application pattern, can be modified as simply as possible.

SUMMARY

The invention solves the problem in the case of an apparatus of the type defined above by having the nozzle opening communicate with the distribution channel by means of a plurality of output channels which are spaced at a distance from each other.

Because of the large number of output channels spaced at a distance from each other, together with the movable piston, it is possible in a simple way to modify the application pattern, in particular the width of the application. At the same time it is possible to prevent what occurs in the existing art, that adhesive which is in the slit between the nozzle opening and distribution channel can flow in the apparatus due to influences of gravity in such a way that the application pattern is influenced disadvantageously, in particular that it can run down at the nozzle opening while the apparatus is stopped, in particular when the apparatus is situated vertically. Because the slit is segmented between the nozzle opening and distribution channel by the output channels, flow components in the direction of the longitudinal direction of the slit-shaped discharge channel can be largely prevented or reduced. This results in uniform application.

It is especially advantageous that the fluid stream through the output channels is optionally releasable or interruptible with the help of the piston. It is possible to select by the position of the piston which of the output channels have adhesive flowing through them. Because the piston has a section which forms a narrow annular gap between its outer circumferential surface and the inner surface of the distribution channel, the section of the distribution channel occupied by the piston is sealed off, so that no fluid can penetrate into this section. As a consequence, output channels which are located in the section of the distribution channel sealed off by the piston can no longer have fluid flowing through them, the result of which is that there is also no fluid flowing from the nozzle opening in this section. The width of the application surface is variable in steps by the number of outlet channels through which fluid flows. The number of output channels through which fluid flows is determined by the position of the piston in the distribution channel. The output channels can be characterized as follows by the sealing effect of the end of the piston in contact with the fluid, as described above: depending on the position of the piston in the distribution channel, they are either in front of or behind the end of the piston that is in contact with the fluid—viewed in the direction of flow of the fluid. Output channels that are located in front of the end of the piston have fluid flowing through them, while output channels that are located behind the end of the piston are cut off from the supply of fluid. As a direct result of this connection, the position of the piston in the distribution channel also determines the width of the application surface.

A preferred embodiment proposes that the output channels and the nozzle opening be formed in a nozzle arrangement that is separable from the basic body. This is advantageous from the perspective of production technology, since it creates the possibility of realizing design features that are needed to produce the desired application pattern of the adhesive in a simple way. Examples of such design features could be projections for tear-off edges or recesses for a locally increased provision of adhesive, as described in DE 20 308 257. In addition, it is conceivable to use other materials for the nozzle arrangement than for the basic body, which are better suited for providing the design features named above.

A preferred embodiment of the invention provides that the nozzle arrangement be made up of a first sub-block and a second sub-block, which are detachably connectable with each other and with the basic body. Dividing the nozzle arrangement into two sub-blocks increases the accessibility of both the distribution channel and the output channels, so that the latter can be cleaned and freed of hardened adhesive residues in a simple way.

The invention is advantageously further refined by having the output channels formed by depressions on the corresponding surface of only one of the sub-blocks. The advantage from the perspective of production technology is that only one sub-block has to be machined, so that the time and cost of manufacturing can be reduced. Another advantage is that only one sub-block has to be exchanged when the application makes it necessary to use output channels with different geometric properties.

According to a preferred embodiment of the invention, the output channels have a cross section that grows larger toward the nozzle opening. The enlargement of the cross section has the advantage that with appropriate dimensioning the fluid dispensed from the nozzle opening forms a closed application surface, but that nevertheless on the side adjacent to the distribution channel the interval between the channel inputs is great enough to have a sealing surface of sufficient size to be able to seal off the output channels by the piston reliably. Furthermore, the piston does not have to be positioned so precisely to prevent an output channel from being closed only partially by the piston.

The invention is further distinguished by the fact that the output channels have an essentially rectangular cross section. This is more favorable than round cross sections for production reasons, since rectangular cross sections can be milled more simply into the corresponding surface of the sub-block of the nozzle arrangement.

According to an alternative exemplary embodiment of the invention, the distance between the output channels is chosen so that the fluid dispensed from the nozzle opening forms a closed application surface, which is desired in some applications. This achieves an especially uniform coating thickness when applying adhesive, in particular hot-melt glue. The uniformity of this coating thickness has a particular effect on the quality of the adhesive bond. In particular when gluing labels to transparent containers such as bottles, sections of surface with an increased or reduced application of adhesive give a negative impression. The delivery of the adhesive proposed here, through the output channels whose spacing is chosen so that a closed application surface results, fulfills the demand for a uniform thickness of the coating on the application surface, which is desired for example when gluing labels to transparent containers such as bottles.

An alternative exemplary embodiment proposes that the distance between the output channels be chosen so that the fluid dispensed from the nozzle opening forms an application surface which is made up of a number of strips spaced at a distance from each other. In some applications it is not necessary to provide the entire contact surface with adhesive. It is sufficient here to apply the adhesive to the contact surface in several strips, spaced at a distance from each other. In this way it is possible to achieve a saving of adhesive without having to accept a significant reduction of the quality of the adhesive bond.

The invention is further refined by having a rotatably supported screw spindle mesh with a threaded body that is rigidly connected to the piston. This arrangement makes it possible to adjust the position of the piston in the distribution channel precisely without tilting the piston, which could cause its sealing effect to be lost. In addition to the possibility of adjusting the piston position, the screw spindle also produces the effect that the position setting of the piston is preserved even under the pressure that builds up due to the fluid stream in the distribution channel. Alternatively, the linear displacement of the position of the piston can also be realized by a chain drive, which significantly reduces the required construction space. A design of this sort is described in detail in EP 1 501 640.

A refinement of the invention consists in the screw spindle being coupled through a worm gear to a rotary knob for manually adjusting the position of the piston in the distribution channel. The use of a rotary knob to operate the screw spindle makes manual adjustment of the position of the piston simpler and more convenient. Depending on the installation situation, it can be beneficial to change the layout of the axis of rotation, for example when the apparatus is poorly accessible from one side. Such a change in the layout of the axis of rotation can be achieved by means of an appropriately designed worm gear. Furthermore, by using gearing, it is possible optionally to realize a transmission ratio, whereby it is both possible to adjust the position of the piston even more exactly, and the exertion of force which this requires can be reduced significantly.

A preferred embodiment of the invention is distinguished by the fact that a latching element is situated between the screw spindle and the gear set and works together with the rotary knob, the gear set and the screw spindle in such a way that the piston is movable discontinuously by the distance between two output channels. The latching element consists of a spring-loaded ball, which snaps into a recess perceptibly after a rotation of 360°. A rotation of the latching element by 360° causes the piston to be shifted by exactly the distance between two output channels. Such a discontinuous movability of the piston by the distance between two output channels is helpful in order to ensure that an output channel has fluid flowing through it either completely or not at all. The screw spindle, the latching element and the piston are matched to each other so that the end of the piston which is in contact with the fluid is always positioned directly at the upper boundary surface of the last output channel with fluid flowing through it—viewed in the direction of flow of the fluid. Alternatively, the rotary knob and the worm gear can also be omitted, and the screw spindle can be rotated directly by actuating the latching element.

BRIEF DESCRIPTION OF THE DRAWINGS

The invention will now be described on the basis of an exemplary embodiment of the apparatus according to the invention for applying fluids such as adhesive, in particular hot-melt glue, onto a substrate that is movable relative to the apparatus, with reference to the accompanying drawings. The figures show the following.

DETAILED DESCRIPTION

Figure 1:
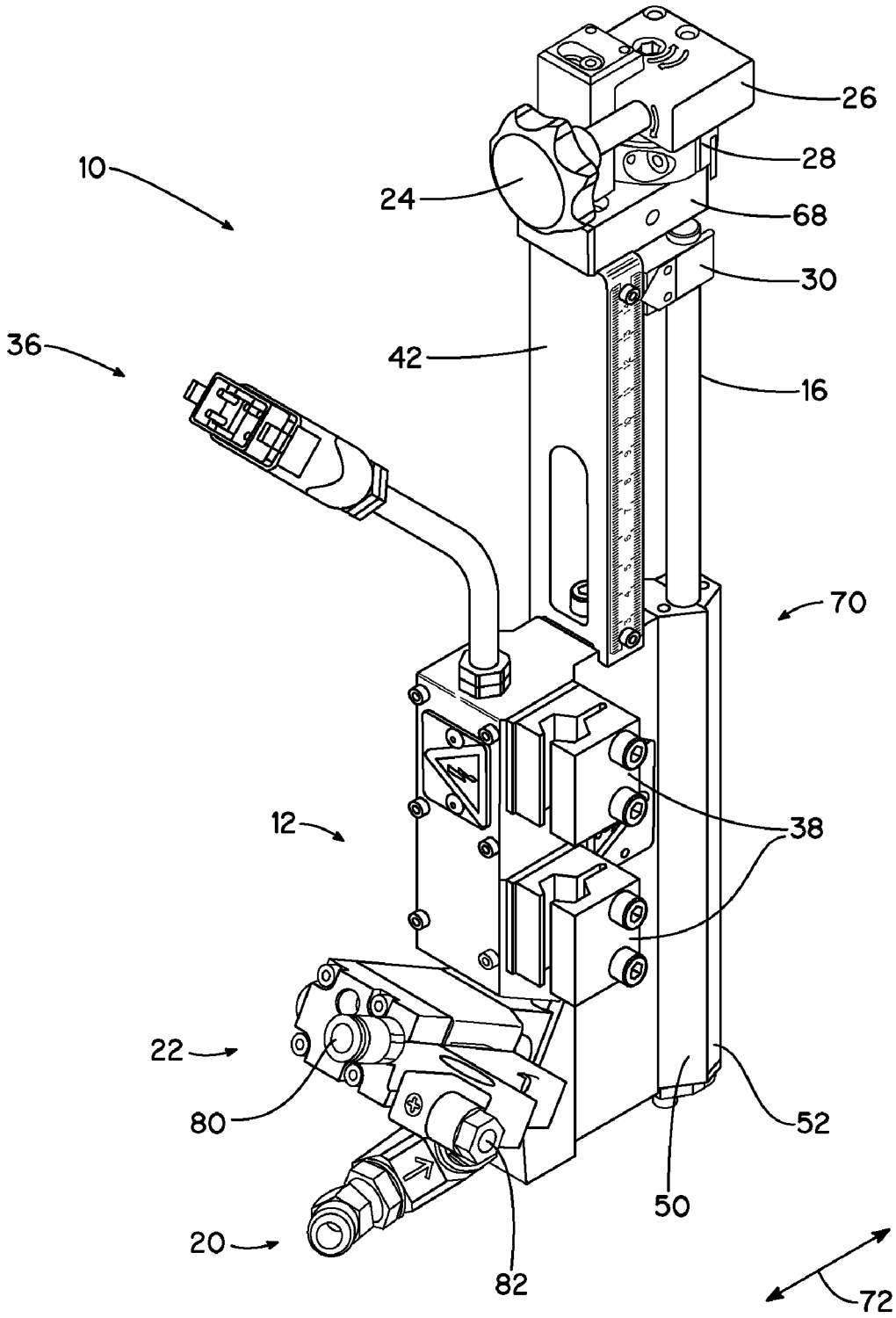
FIG. 1 is a perspective view of an apparatus according to the invention for applying fluids to a substrate that is movable relative to the apparatus.
Figure 2:
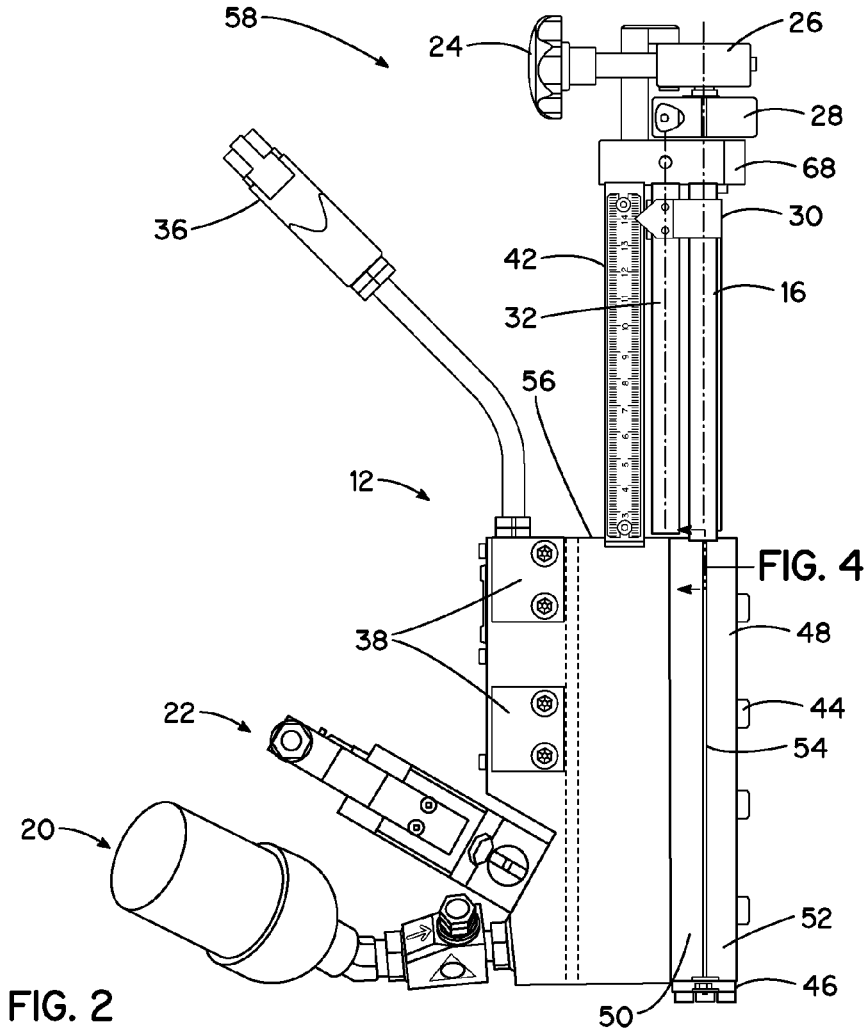
FIG. 2 is a front view of the apparatus from FIG. 1.

The apparatus 10 depicted in FIG. 1 is used to apply fluids such as adhesive, in particular hot-melt glue, to a substrate that is movable relative to the apparatus 10 in the direction of arrow 72. The apparatus includes an electropneumatically operable applicator valve 22, which is connectable to a basic body 12. On one side of basic body 12 a nozzle arrangement 70 is removably attached by means of threaded connections 44 and centered with pins 48 (FIG. 2). The nozzle arrangement includes two partial blocks 50 and 52. Apparatus 10 can be connected by a hose 20 to a fluid source (not shown). Apparatus 10 is supplied with electrical energy through connecting element 36. Apparatus 10 can be fixed in its position with the help of fastening elements 38.

Electrically operable applicator valve 22 has an electrical connection 82 and a pressurized air connection 80, by means of which a pressurized air source (not shown) can be connected. In this way the possibility is created of selectively interrupting or releasing the flow of fluid through basic body 12 and carrying out an intermittent application of adhesive.

It can be seen from FIG. 2 that nozzle arrangement 70 has an essentially slit-shaped nozzle opening 54 through which the fluid is dispensed and applied to the substrate. The nozzle arrangement includes a cylindrically shaped distribution channel 14 (see FIG. 3 and FIG. 4), in which a piston 16 is movably situated. Piston 16 is movable in distribution channel 14 by means of adjusting apparatus 58.

Adjusting apparatus 58 includes a holding apparatus 42, which is removably attached to a surface 56 of basic body 12. Also connected to holding apparatus 42 is a bearing plate 68. A screw spindle 32 is rotatably supported in bearing plate 68 and in the surface 56 of basic body 12 by means of journal bearings. Screw spindle 32 can be turned by means of a rotary knob 24. In the depicted exemplary embodiment, rotary knob 24 is connected to screw spindle 32 through a worm gear 26, so that the axis of the rotary motion can be changed. This arrangement opens up the possibility of orienting the rotary knob 24 so that it is more accessible. This is particularly advantageous when there is not much construction space available for the apparatus 10. Furthermore, holding apparatus 42 is equipped with a scale by means of which the exact position of piston 16 in distribution channel 14 can be ascertained.

Figure 3:
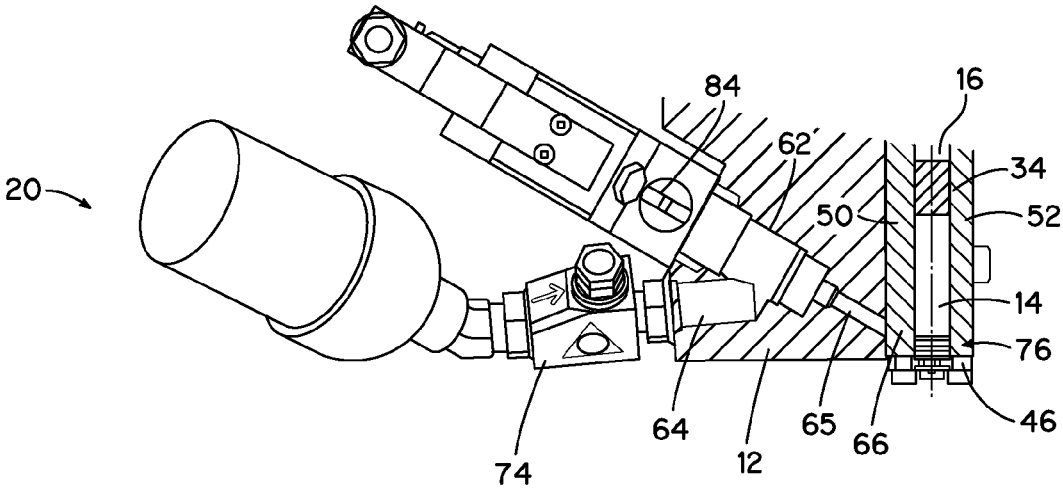
FIG. 3 is a lower section according to FIG. 2 in a partial section representation.

FIG. 3 depicts the flow of fluid from the fluid source (not shown) into distribution channel 14. The fluid is transported by a means of conveyance (not shown), for example a pump, through hose 20, which is connected to a hose connection 74, in which a filter is situated, into a hole 64 located in basic body 12. Hole 64 leads into a hole section 62 which is sealed above and below the mouth of hole 64 in a manner not depicted, with O-rings which are integrated into a cylindrical hollow body of applicator valve 22. The fluid enters into a channel (not shown) in the hollow body of applicator valve 22, oriented as an extension of hole 65, in which valve needle 84 runs. Farther downstream the channel expands. In this expansion valve needle 84 also expands and forms a valve body, which is dimensioned so that the flow of fluid is interrupted by contacts of the valve body against complementary surfaces of the enlargement of the channel. Since the flow of fluid is interrupted by a shift of the valve body in the upstream direction, the after-dripping described earlier can be reduced. A detailed description of how such an applicator valve works can be found in EP 0 850 697.

After the fluid has passed the valve seat, it flows on through hole 65, which communicates with hole 66, which is located in sub-block 50. Hole 66 issues into distribution channel 14, which is bounded and sealed laterally by sub-blocks 50 and 52 and on its first end face by sealing plate 46 and a sealing element 76 optionally screwed into it, and on its second end face by piston 16.

Figure 4:
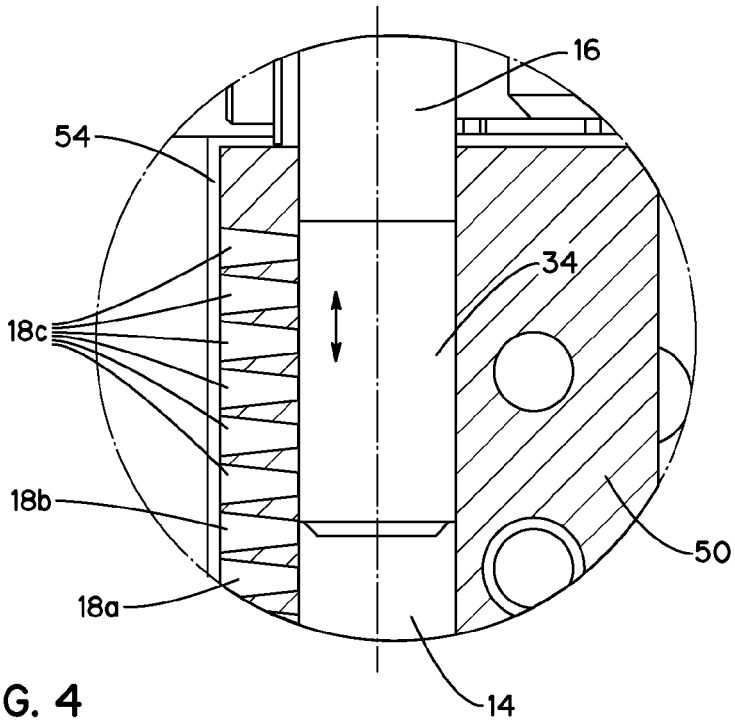
FIG. 4 is an enlarged partial section representation according to the detail of the upper part of the nozzle arrangement identified in FIG. 2.

FIG. 4 shows additional details of a section of distribution channel 14 according to FIG. 2. Piston 16 has an end 34 which is in contact with the fluid, which forms a narrow annular gap between its outer circumferential surface and the inner surface of distribution channel 14, so that the section of distribution channel 14 occupied by piston 16 is sealed off and no fluid can penetrate into this section. Furthermore, sub-block 50 has output channels 18, which communicate with the section of distribution channel 14 filled with fluid and with nozzle opening 54. The fluid conveyed into distribution channel 14 flows on through the opened output channels 18*a* and 18*b* to nozzle opening 54, through which the fluid is dispensed and applied to the substrate. The output channels designated in FIG. 4 as 18*c* are closed by the piston and have no fluid flowing through them. The position of the piston can be used to choose the ratio of output channels with fluid flowing through them and closed output channels, and to vary the width of the resulting application surface. It is beneficial to the technology of flow for the output channels to be either completely open or completely closed. A partially opened output channel would cause irregularities in the fluid supply, so that uniform application would not be achieved. Piston 16 is positioned so that a largely offset-free and edge-free transition results in distribution channel 14 between the piston end 34 and the last output channel 18*b* through which fluid flows. This is achieved, as shown in FIG. 4, when piston end 34 is positioned flush with an upper boundary surface 78 of the current last output channel 18*b* through which fluid is flowing. The corresponding positioning of piston 16 is achieved by providing a latching element 28 between worm bear 26 and screw spindle 32 (FIG. 2), which causes piston 16 to be moved discontinuously by the distance between two adjacent output channels 18.

Figure 5:
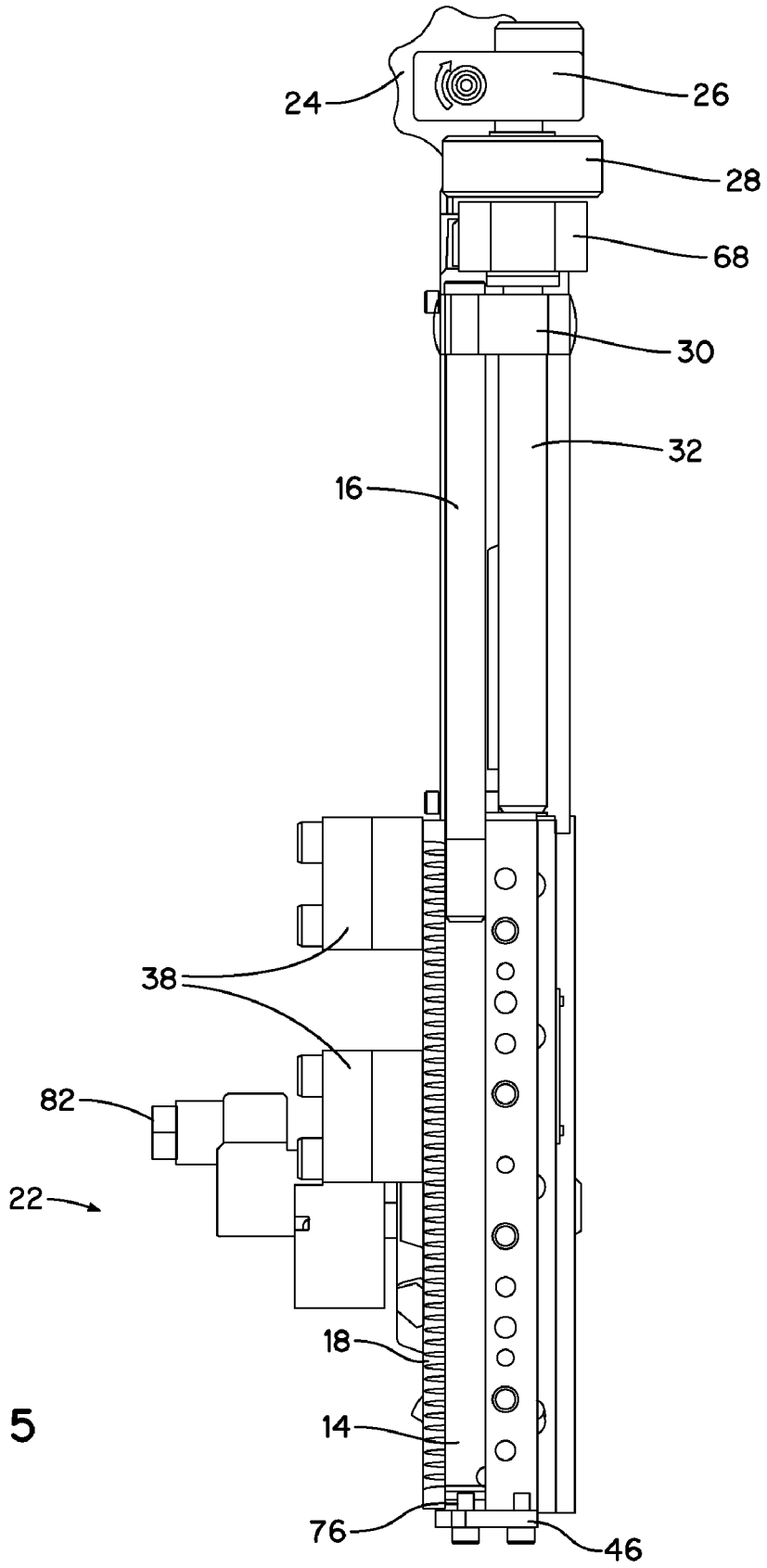
FIG. 5 is a side view of the apparatus from FIG. 1 for applying fluids to a substrate that is movable relative to the apparatus.

FIG. 5 shows a side partial section view of the apparatus 10. It can be seen how piston 16 works together with distribution channel 14, sealing plate 46 and an optional sealing element 76, and output channels 18. It can also be seen from the figure that the rotation of rotary knob 24 is transferred through worm gear 26 to screw spindle 32, and how the rotary motion is converted to a linear motion by means of threaded body 30 and transferred to piston 16, which is rigidly connected to threaded body 30. It is also evident where the fastening elements 38 are attached to basic body 12. In the background the side parts of applicator valve 22 can be recognized, in particular the side connection 82 for the pressurized air supply.

Figure 6:
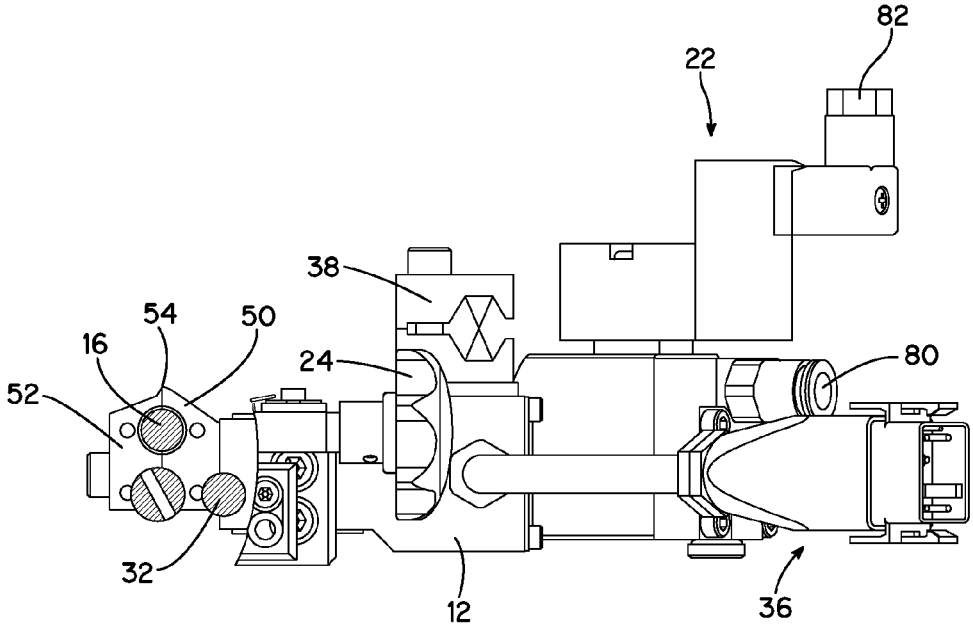
FIG. 6 is a top view of the apparatus from FIG. 1 for applying fluids to a substrate that is movable relative to the apparatus.

In FIG. 6 the apparatus 10 is shown in a top view. Here the two sub-blocks 50 and 52, which attach to basic body 12 and form nozzle opening 54, become visible. In addition, the position of screw spindle 32 and of piston 16 in relation to each other and the position of rotary knob 24 are readily visible. Furthermore, the figures show the fastening element 38, the two connections 80 and 82 for the supply of pressurized air to applicator valve 22 and the cable connection 36 for supplying the apparatus with electrical energy.

What is claimed is:

1. An apparatus for applying fluid onto a substrate moving relative to said apparatus, comprising:

a basic body configured to be connected to a fluid source and including a distribution channel with a length that can be acted upon with the fluid, a piston positioned in said distribution channel, and a slit-shaped nozzle opening in fluid communication with said distribution channel, said piston being movable in said distribution channel so as to vary said length, said slit-shaped nozzle opening communicating with said distribution channel via a plurality of spaced apart outlet channels;

an application valve coupled to said basic body for selectively interrupting or enabling a flow of the fluid through said basic body;

a rotatable latching element; and a recess configured to receive said rotatable latching element therein at discrete angular positions of said rotatable latching element, said angular positions corresponding to a plurality of spaced, available stopping positions of said piston along said distribution channel.

2. The apparatus of claim 1, wherein movement of said piston selectively enables or interrupts the flow of fluid through said plurality of spaced apart outlet channels.

3. The apparatus of claim 1, wherein the fluid at said slit-shaped nozzle opening defines an application surface, said application surface being variable stepwise by the number of outlet channels through which the fluid flows.

4. The apparatus of claim 1, wherein said distribution channel, said plurality of spaced apart outlet channels, and said nozzle opening define a nozzle assembly that is separable from said basic body.

5. The apparatus of claim 4, wherein said nozzle assembly includes a first block and a second block, said first and second blocks being releasably coupled to one another and to said basic body.

6. The apparatus of claim 5, wherein said plurality of spaced apart outlet channels are formed by depressions on a surface of only one of said first and second blocks.

7. The apparatus of claim 1, wherein at least one of said plurality of spaced apart outlet channels defines a cross-section, said cross-section enlarging toward said nozzle opening.

8. The apparatus of claim 1, wherein at least one of said plurality of spaced apart outlet channels defines a substantially rectangular cross-section.

9. The apparatus of claim 1, wherein spacings between said plurality of spaced apart outlet channels are such that the fluid delivered through said slit-shaped nozzle opening forms a closed application surface.

10. The apparatus of claim 1, wherein spacings between said plurality of spaced apart outlet channels are such that the fluid delivered through said slit-shaped nozzle opening defines a plurality of mutually spaced strips.

11. The apparatus of claim 1, further comprising:

a threaded spindle and a threaded body, said threaded spindle being rotatably coupled to said threaded body, said threaded body being rigidly connected to said piston for moving said piston in said distribution channel.

12. The apparatus of claim 11, further comprising:

a rotary knob coupled to said threaded spindle for manual adjustment of the position of said piston in said distribution channel.

13. The apparatus of claim 11, further comprising:

a gear set coupling said rotary knob to said threaded spindle, said rotatable latching element being arranged between said threaded spindle and said gear set, said rotatable latching element cooperating with said rotary knob, said gear set, and said threaded spindle such that movement of said piston in said distribution channel is discontinuous and associated with a spacing between two of said outlet channels.

14. An apparatus for applying fluid onto a substrate moving relative to said apparatus, comprising:

a basic body configured to be connected to a fluid source and including a distribution channel with a length that can be acted upon with the fluid, a piston positioned in said distribution channel, and a slit-shaped nozzle opening in fluid communication with said distribution channel, said piston being movable in said distribution channel so as to vary said length, said slit-shaped nozzle opening communicating with said distribution channel via a plurality of spaced apart outlet channels;

an application valve coupled to said basic body for selectively interrupting or enabling a flow of the fluid through said basic body;

wherein said distribution channel, said plurality of spaced apart outlet channels, and said slit-shaped nozzle opening define a nozzle assembly that is separable from said basic body; and said nozzle assembly includes a first block and a second block, said first and second blocks being releasably coupled to one another and to said basic body and said first block having a first portion of said distribution channel therein and said second block having a second portion of said distribution channel therein.

15. The apparatus of claim 14, wherein said plurality of spaced apart outlet channels are formed by depressions on a surface of only one of said first and second blocks.

16. The apparatus of claim 14, wherein at least one of said plurality of spaced apart outlet channels defines a cross-section that enlarges toward said slit-shaped nozzle opening.

17. The apparatus of claim 14, wherein spacings between said plurality of spaced apart outlet channels are such that the fluid delivered through said slit-shaped nozzle opening forms a closed application surface.

18. The apparatus of claim 14, wherein spacings between said plurality of spaced apart outlet channels are such that the fluid delivered through said slit-shaped nozzle opening defines a plurality of mutually spaced strips.

19. The apparatus of claim 14, further comprising:

a rotatable latching element; and a recess configured to receive said rotatable latching element therein at discrete angular positions of said rotatable latching element, said angular positions corresponding to a plurality of spaced, available stopping positions of said piston along said distribution channel.

* * * * *